US005468068A

United States Patent [19]

Hotchkiss, III

[11] Patent Number: 5,468,068

[45] Date of Patent: Nov. 21, 1995

[54] METHOD OF TINT MIXING AND DELIVERY

[76] Inventor: Wesley E. Hotchkiss, III, 212 Flametree Cir., Windsor, Calif. 95492

[21] Appl. No.: 323,794

[22] Filed: Oct. 17, 1994

[51] Int. Cl.[6] ..... B01F 15/04

[52] U.S. Cl. ..... 366/348; 366/349; 366/605; 222/1

[58] Field of Search ..... 366/160.1, 160.3, 366/162.1, 150.1, 605, 349, 348, 152.1, 189; 53/390, 481; 222/144, 144.5, 1, 107

[56] References Cited

U.S. PATENT DOCUMENTS

| | | | |
|---|---|---|---|
| 2,528,530 | 11/1950 | Machleder | 366/605 |
| 2,648,463 | 8/1953 | Scherer | 222/107 |
| 2,975,939 | 3/1961 | Russel et al. | 222/144 |
| 3,298,671 | 1/1967 | Pompa et al. | 366/342 |
| 4,941,520 | 7/1990 | Dowzall et al. | 366/605 |
| 5,313,767 | 5/1994 | Gentile | 53/481 |

FOREIGN PATENT DOCUMENTS

| | | | |
|---|---|---|---|
| 3543052 | 6/1987 | Germany | 366/605 |
| 2060800 | 3/1990 | Japan | 366/605 |
| 15547 | 10/1991 | WIPO | 366/605 |

*Primary Examiner*—David Scherbel
*Assistant Examiner*—Tony G. Soohoo
*Attorney, Agent, or Firm*—Harris Zimmerman

[57] ABSTRACT

A tint mixing and dispensing system includes a plastic bag holder for storing a plurality of tint bags, and dispensing the bags one at a time for receiving and mixing tinting substances. The bag holder includes a vertical stand supported on a base plate, and a pair of arms extend outwardly from the vertical stand to support a bag with the upper unsealed end in an open disposition. The bag holder includes a flange extending from the base plate thereof, so that the holder may be slidably translated along a shelf below an array of tint storage and metering units. A bag sealing stand includes a stage for receiving and supporting the bag holder assembly, and a bag sealing device for hermetically sealing a tint bag after it is filled with a desired tint mix. The bag sealer may be supported on a sealer stand, which also supports a roll of plastic bag material. The method includes the steps of measuring and depositing tinting compounds into the open end of a plastic tint bag, and sealing the bag to maintain the tint mixture until use. To use the tint mixture, the bag is punctured or cut, and the bag may be squeezed and emptied into the container of base surfacing material.

6 Claims, 4 Drawing Sheets

METHOD OF TINT MIXING AND DELIVERY

BACKGROUND OF THE INVENTION

This invention relates to tinting systems for color additives used in paint, plaster, and similar surface coatings, and is more particularly directed to a system for accurately and reproducibly tinting such products.

In the building trades many surface coating materials are used to finish the exterior walls and interior rooms. These materials, which include paint, plaster, stucco, and other architectural surface products, are generally colored by the provision of a neutral-color base coating material and a selection of tinting additives. Judicious and artistic combinations of the tinting material mixed into the base material may create a wide range of colors suitable for most architectural and engineering demands.

The base materials for each type of surface coating are generally distributed in canisters, pails, or barrels, and the tinting material is mixed into each container individually. The mixing step may take place just prior to use of the material, or may be accomplished by the distributor prior to sale. In either case, it is critical that the tint proportions and amount are identically matched for all the containers, so that there will be no color variations in applications that require multiple containers of the material. Tints are generally dispensed from finely graduated measuring cylinders into a mixing cup or similar container. The tint materials are fully mixed in the cup, and then poured into the pail or can of base surfacing material. For mixes that are to be stored for any length of time or shipped, it is a common practice to add water to the tint mix in an amount sufficient to maintain a complete intermixture of colorants, while not causing precipitation or settling. The thinning effect of the added water renders the mixture unsuitable for packing in threaded vials or containers, due to the potential of leakage past the threads.

Although this system is capable of creating batches of tint mixes that have virtually identical proportions, there is a difficulty in delivering 100% of the tint mix from the cup. It is necessary to scrape the residue of tint from the cup to assure that the entire tinting lot is mixed into the base material. Considering the staining potential of the tinting mix, it often happens that the individual mixing the material may avoid a messy task by avoiding scraping all of the tint from the mixing cup. The result is a slight variation in the amount of tinting mix added to each container, causing color and color density variations in successive lots of tinted surfacing material. These variations may be too subtle to be noticed prior to application when it is liquid or wet, but may become apparent after they have dried and set. Repair or reapplication may be required, causing increased cost as well as dissatisfaction with the product.

SUMMARY OF THE PRESENT INVENTION

The present invention generally comprises a tint mixing and dispensing system for use particularly in coloring paints, plaster, stucco, and other architectural surfacing products. The tinting system is designed to provide uniform and reproducible coloring among many batches of surfacing products, and to provide a convenient arrangement for mixing, storing, and adding tints to such surfacing products and other neutral-color base materials that require coloring.

The invention includes the steps of measuring and depositing tinting compounds into the open end of a plastic tint bag for storage and mixing. After the addition of a small amount of water (e.g., up to 33% by volume), the plastic bag is sealed by a conventional thermal bag sealer or the like to store, distribute, sell, and otherwise maintain the tint mixture until it is added to a container of base material. To use the tint mixture, the bag may be punctured or cut, and the tint mixture discharged from the bag into the container of base surfacing material. The bag may be squeezed and emptied virtually completely, so that all the tint is incorporated into the surfacing material. The added water reduces the viscosity of the mixture so that the liquid is easily emptied from the bag. Each bag contains a charge of tint mixture sufficient to color one container of base surfacing material. This feature assures that the volume of tint material added to each container is very similar or identical, so that variations in batch tint is minimized or eliminated.

In another aspect of the invention, a plastic bag holder is provided for storing a plurality of tint bags, and dispensing the bags one at a time for receiving and mixing tinting substances. The bag holder includes a vertical stand supported on a base plate, and a pair of arms extend outwardly from the vertical stand to engage aligned holes in the side margins of a plurality of plastic bags. The arms include distal portions that taper and converge each toward the other, and terminate in distal tines. The tines are spaced closer together that the width of each plastic bag, so that the bag is supported with the upper unsealed end in an open disposition. The bag holder includes handles extending therefrom, so that it may be moved between tint storage and metering units (known in the prior art) which dispense measured amounts of standard tint colors into the open bag. Thus the bag holder may be used to support an open bag while it receives one or more charges of tinting material, the mix in the bag subsequently being used to tint a standard volume or mass of basic material.

The bag holder may further be equipped with a flange extending from the base panel thereof, so that the holder may be slidably translated along a shelf below an array of tint storage and metering units. Indexing indicia or mechanisms may be provided to facilitate placing the tint bag holder precisely below each of the tint dispensers, so that all the tint material is discharged into the open bag.

Another aspect of the invention is the provision of a plastic bag sealing device (known in the prior art) for hermetically sealing a tint bag after it is filled with a desired tint mix. The sealed bag prevents oxidation or other chemical process from affecting the color properties of the tint mix, and likewise prevents unwanted accidental intrusion of contaminants into the tint mix. The tint mix may be stored indefinitely in the sealed bag, and/or shipped in the sealed bag to a destination where it is mixed with a standard-size container of neutral-color or undyed base coating material.

The bag sealer may be supported on a sealer stand, which also supports a roll of plastic bag material; e.g., a continuous longitudinal strip formed of confronting plastic webs sealed or otherwise joined at opposed edges to form longitudinally extending margin strips. A plurality of holes are disposed in the margin strips in longitudinally spaced fashion to engage the support arms of the bag holder. The strip is adapted to be fed into the bag sealer so that bags of a wide range of length and volume may be fabricated and sealed easily and quickly. The sealer stand further includes a stage for receiving and supporting the bag holder assembly. Thus a plastic bag containing a mix of tint materials may be supported on the support arms of the bag holder, and placed directly beneath the bag sealer. The bag may then be removed from the support arms and engaged directly with the bag sealer, so that the opportunity for spills, contamination, or errors is eliminated.

DESCRIPTION OF THE PREFERRED EMBODIMENT

Figure 1:
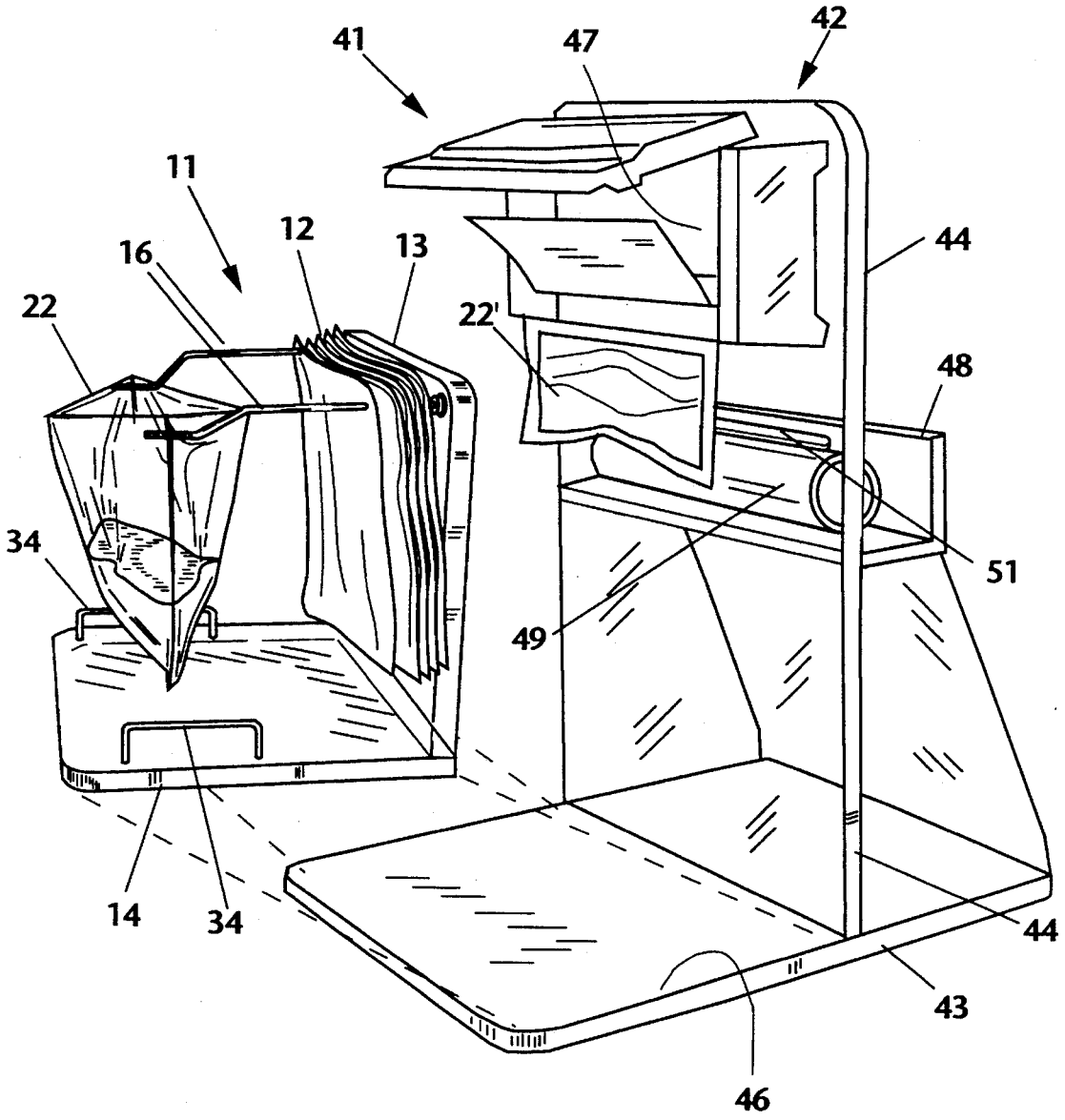
FIG. 1 is an exploded perspective view depicting the bag holder arrangement and the bag sealing arrangement of the invention.

The present invention generally comprises a tint mixing and dispensing method and apparatus for use particularly in coloring paints, plaster, stucco, and other architectural surfacing products. The tinting system is designed to provide uniform and reproducible coloring among many batches of surfacing products, and to provide a convenient arrangement for mixing, storing, and adding tints to such surfacing products and other neutral-color base materials. With regard to FIGS. 1–4, the apparatus of the invention includes a plastic bag holder 11 for storing a plurality of plastic bags 12 having sealed edges at the bottom and sides, and an open upper edge. Each plastic bag 12 comprises a single-use container for receiving and mixing tinting substances, preferably in carefully measured amounts, to define a particular color additive for the neutral base material. Most surfacing compounds are sold and distributed in standard containers (cans, pails, barrels, drums, etc.) having standardized sizes, and the amount of color additive is proportioned to the material and container size to which it will be added.

The bag holder 11 includes an upright panel 13 extending upwardly from a rear edge of a base panel 14. A pair of support arms 16 extend horizontally from an upper portion of the panel 13. The arms are enantiomorphic, each comprising a proximal linear section 17, and oblique portion 18, and a distal linear portion 19. The oblique portions 18 are angled downwardly in mutually converging fashion, and the paired sections 17 and 19 are parallel and spaced apart. Moreover, the sections 19 are spaced closer together than the sections 17. The distal portions 19 further include a plurality of serrations in the upper surface thereof to retain an outermost plastic bag 22, as will be explained in the following description.

Each plastic bag 13 may be formed of parallel webs or films of an impervious, non-form-retaining polymer (polyethylene or the like) that are joined along side margins 24 and a bottom edge 26. A plurality of holes 27 are formed in the margins 24 in longitudinally spaced fashion, the holes 27 being dimensioned to receive the support arms 16 therethrough. Given the minimal thickness of each plastic bag 12, a plurality of bags (comprising several tens of bags) may be stored on the arms 16. The spacing of the linear portions 17 is approximately equal to the lateral distance between two opposed holes 27. However, the closer spacing of the distal portions 19 of the arms creates slack in the bag 22 supported on the portions 19 and causes the parallel webs that define the bag 22 to separate, defining an upper opening 23 for filling the bag 22. The arms 16 are thus configured to present the outermost bag 22 for dispensing and filling.

Figure 2:
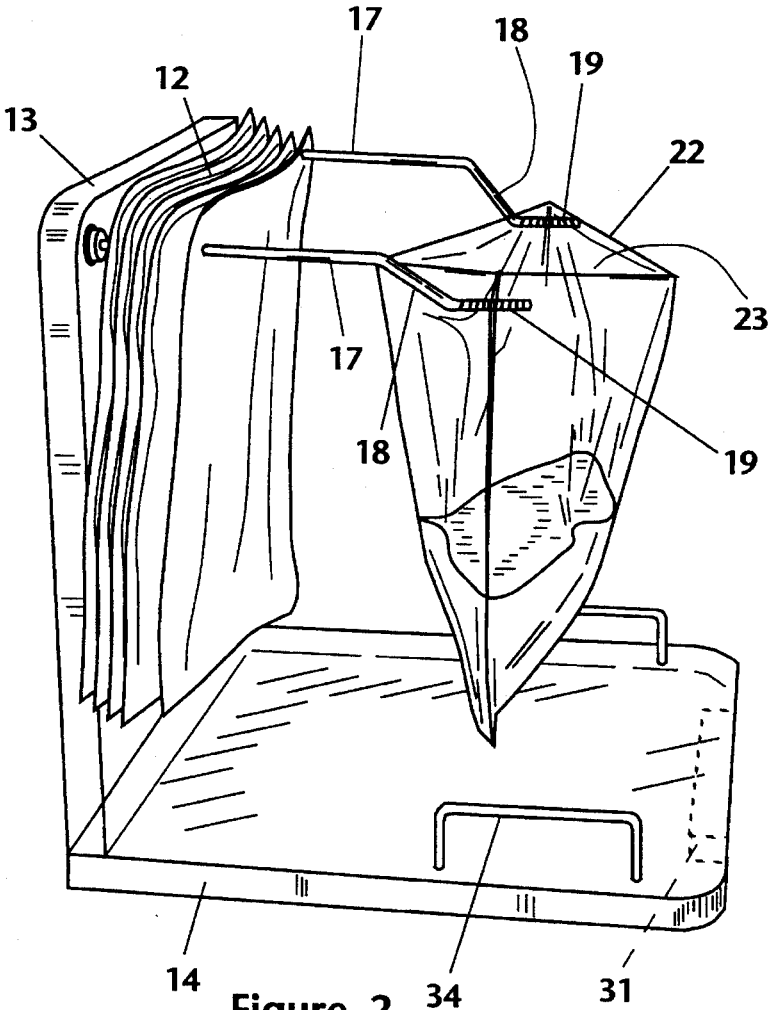
FIG. 2 is a perspective view of the bag holder assembly of the invention.
Figure 3:
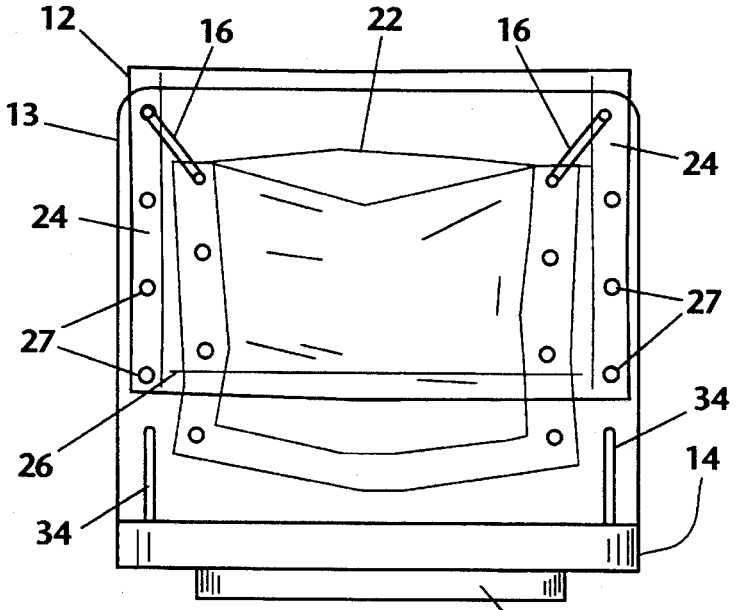
FIG. 3 is a front elevation of the bag holder assembly depicted in FIGS. 1 and 2.
Figure 4:
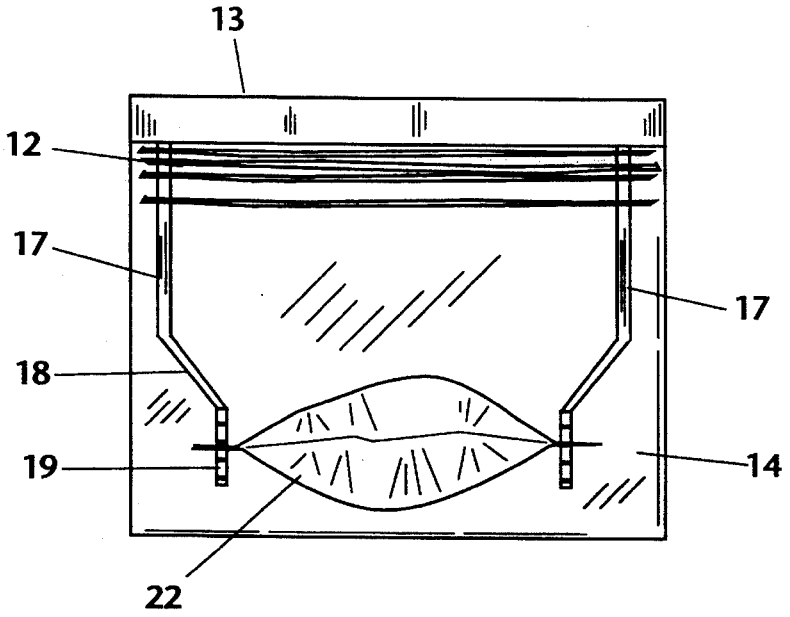
FIG. 4 is a top view of the bag holder assembly depicted in FIGS. 1–3.
Figure 5:
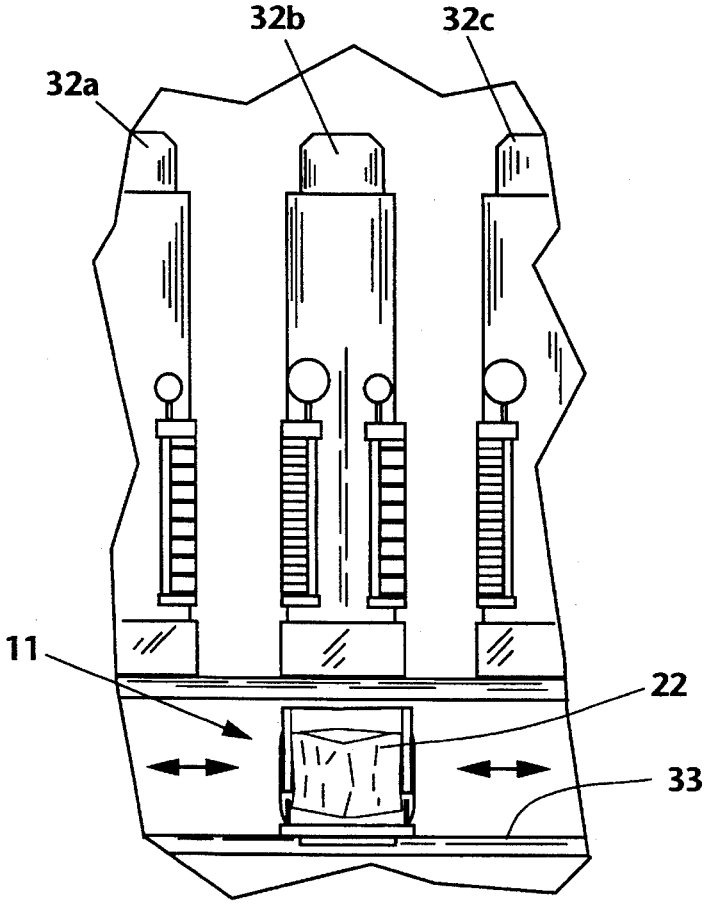
FIG. 5 is a front elevation depicting the bag holder assembly of the invention in use with a plurality of tint dispensing and metering containers.

The bag holder 11 further includes a flange 31 extending downwardly from a medial portion of the front edge of the base panel 14, as shown particularly in FIGS. 2 and 3. Given that a typical tint mixing setup includes a plurality of tint dispensing and metering stations 32*a*, 32*b*, and 32*c*, (FIG. 5), a shelf 33 below the stations 32 is provided to support the bag holder 11. The flange 31 facilitates sliding the bag holder 11 along the shelf 33 to be position below the stations 32 that are to be used to discharge tint in measured amounts into the open bag 22. The shelf may be provided with indexing indicia or detents that permit the bag holder 11 to be positioned directly beneath the discharge path of any station 32, so that the open bag will automatically receive the tint material being dispensed. The bag holder further includes a pair of handles 34 for moving and manipulating the bag holder.

The apparatus further includes a bag sealing assembly 41, including a bag sealing stand 42, as shown in FIG. 1. The stand 42 includes a base panel 43 and an upright panel 44 secured to the base panel 43. The base panel 43 includes a stage portion 46 dimensioned to receive and support the bag holder assembly 11, and a plastic bag sealing appliance 47 (known in the prior art) is supported on the panel 44 directly superjacent to the stage portion 46. The bag sealing assembly 41 may be located at the end of the shelf 33 of the tint mixing setup, or some other nearby convenient space. When a bag 22 is filled with all the tint compounds selected to impart a desired color to a container of surfacing compound, the bag holder 11 supporting the filled bag is moved to rest on the stage portion 46. The filled bag is then removed directly from the tines 19 of the arms 16, and lifted to the bag sealing appliance 47, where the open upper edge is sealed in one step. The tint charge within the bag is thus protected from external contamination and secured within a durable package that permits easy transport, storage, and use.

The assembly 41 further includes a storage rack 48 secured to the upright panel 44 on the obverse side thereof with respect to the bag sealing appliance 47. A slot 51 extends through the panel 44 adjacent to the rack 48. Secured in the rack 48 is a roll 49 of bag-forming plastic film material, and the bag-forming material may be fed through the slot 51 to the sealing appliance 47. This arrangement facilitates the fabrication of the bags 12 stored on the bag holder 11, as well as non-standard or custom size bags whenever required.

After a bag 22 is filled with tint, a small amount of water (e.g., 33% by volume) is added to permit complete intermixing and lower the viscosity to improve the flow characteristics of the liquid. The bag is sealed, removed from the sealing appliance and subsequently used to tint a container of paint or wall coating material in general. The outermost bag of the plurality of bags 12 supported on the arms 16 is then pulled distally on the arms 16, so that the outermost bag is supported on the distal tines 19 and is held open thereby, thus becoming a new bag 22 disposed for receiving and mixing tinting compounds. The bag holder assembly and bag sealing assembly are thus used reiteratively to fabricate a plurality of tint packages.

Figure 6:
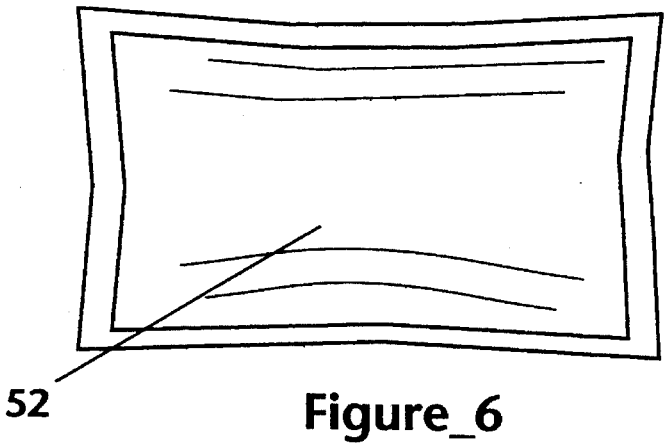
FIG. 6 is a plan view of a charge of tinting substances contained in a sealed plastic bag and formed in accordance with the invention.
Figure 7:
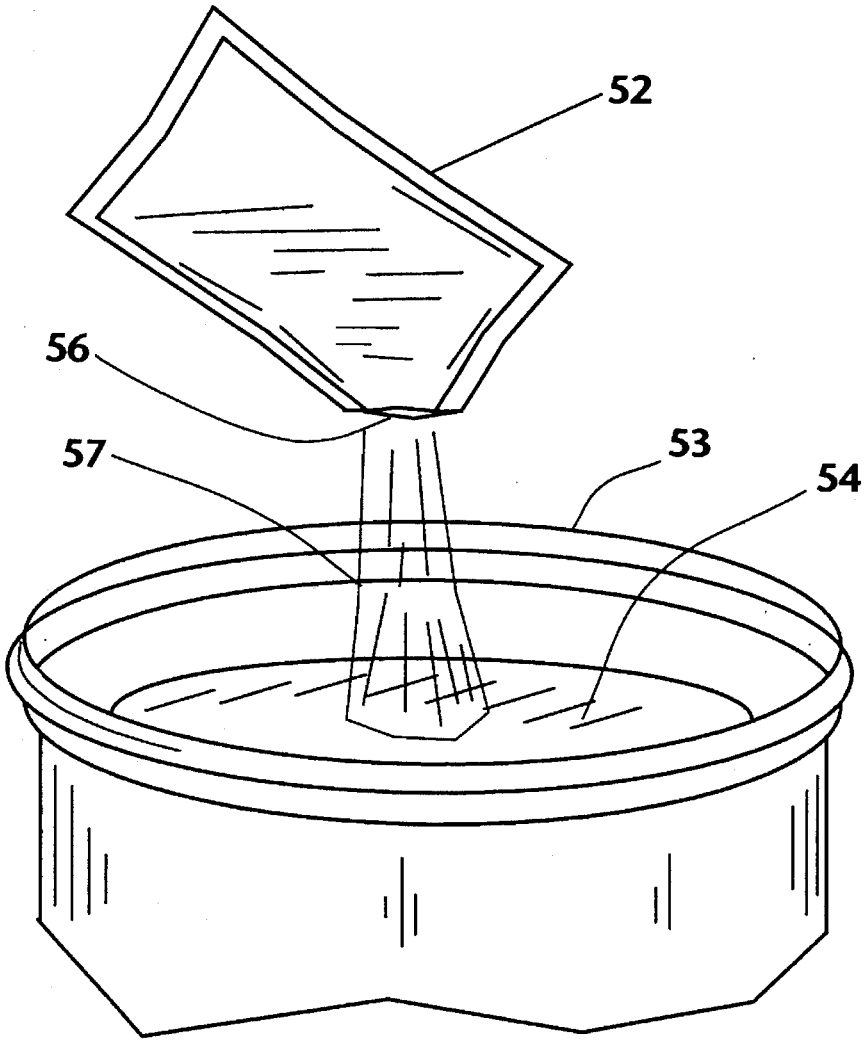
FIG. 7 is a perspective view depicting a portion of the method of the invention, in which a container of untinted material is colored using a plastic bag of tint substances formed by the apparatus of the invention.

With regard to FIG. 6, each tint bag or package 52 formed as described above comprises an hermetically sealed container that permits the tint mixture therein to be stored, shipped, distributed, or used immediately. The typical use of the tint package 52 is in coloring a known quantity of wall surfacing material 54 or the like within a pail or container 53, as shown in FIG. 7. The package 52 is shaken to assure complete intermixing of the tints, punctured, as by cutting open a corner 56, and held inverted over the container 53. The bag 52 may then be emptied by squeezing, wringing, rolling, or in any other manner removing all the tinting mixture 57 from the bag. The tint is then mixed into the material 54 by methods known in the prior art. It is significant that the bag 52 formed of non-form-retaining plastic film permits the complete emptying of the tint charge contained therein, so that all tint batches of identical color will produce the desired uniform tint.

I claim:

1. A method for tinting neutral-color base materials, including the steps of:

providing a plurality of tint compound dispensing and metering stations;

providing an impervious plastic bag having an openable upper end;

depositing measured amounts of a plurality of selected tinting compounds from selected ones of said dispensing and metering stations into the impervious plastic bag to form a tinting mixture;

sealing the open upper end of the impervious plastic bag to form a hermetically sealed package;

providing a container of neutral-color base material;

subsequently disposing the hermetically sealed package above the container of neutral-color base material, puncturing said package and discharging all the contents of the package into the container of base material, thereafter mixing said base material and said contents of the package.

2. The tinting method of claim 1, wherein said discharging step includes compressing and squeezing the package to force all the contents from the package.

3. The tinting method of claim 1, further including the step of supporting the impervious plastic bag with said openable upper end in an open disposition prior to said step of depositing measured amounts of a plurality of tinting compounds into the impervious plastic bag.

4. The tinting method of claim 3, wherein said step of depositing meausured amounts includes supporting the impervious plastic bag in slidably translating fashion beneath a plurality of tint compound dispensing and metering stations, and selectively depositing measured amounts of tint compounds from said stations into the impervious plastic bag.

5. The tinting method of claim 4, wherein said sealing step includes supporting and moving the filled impervious plastic bag to a stage area beneath a bag sealing appliance, and moving the filled bag to the sealing appliance and sealing the bag.

6. The tinting method of claim 1, further including the step of adding water to said impervious plastic bag after said at least one selected tinting compound is added to said impervious plastic bag and before sealing said open end.

* * * * *